US012760381B2

(12) United States Patent
Liu et al.

(10) Patent No.: US 12,760,381 B2
(45) Date of Patent: Oct. 13, 2026

(54) METHOD FOR MANUFACTURING EQUAL-HARDNESS CR5 BACK UP ROLL

(71) Applicant: SINOSTEEL XINGTAI MACHINERY & MILL ROLL CO., LTD., Hebei (CN)

(72) Inventors: Di Liu, Hebei (CN); Yudong Yang, Hebei (CN); Weiguo Han, Hebei (CN); Junxin Su, Hebei (CN)

(73) Assignee: SINOSTEEL XINGTAI MACHINERY & MILL ROLL CO., LTD., Hebei (CN)

( * ) Notice: Subject to any disclaimer, the term of this patent is extended or adjusted under 35 U.S.C. 154(b) by 711 days.

(21) Appl. No.: 18/336,062

(22) Filed: Jun. 16, 2023

(65) Prior Publication Data

US 2023/0332261 A1 Oct. 19, 2023

Related U.S. Application Data

(63) Continuation of application No. PCT/CN2021/090470, filed on Apr. 28, 2021.

(30) Foreign Application Priority Data

Dec. 16, 2020 (CN) ..... 202011491042.1

(51) Int. Cl.

| | |
|---|---|
| ***C21D 1/25*** | (2006.01) |
| ***B21J 1/00*** | (2006.01) |
| ***B21J 1/04*** | (2006.01) |
| ***C21D 8/10*** | (2006.01) |
| ***C21D 9/38*** | (2006.01) |
| ***C22C 38/02*** | (2006.01) |
| ***C22C 38/04*** | (2006.01) |
| ***C22C 38/44*** | (2006.01) |
| ***C22C 38/46*** | (2006.01) |

(52) U.S. Cl.

CPC ..... *C21D 1/25* (2013.01); *B21J 1/003* (2013.01); *B21J 1/04* (2013.01); *C21D 8/10* (2013.01); *C21D 9/38* (2013.01); *C22C 38/02* (2013.01); *C22C 38/04* (2013.01); *C22C 38/44* (2013.01); *C22C 38/46* (2013.01)

(58) Field of Classification Search

CPC ... C21D 9/38; C21D 8/10; C21D 7/13; C21D 6/002; C21D 6/004; C21D 1/18; C21D 1/25

See application file for complete search history.

(56) References Cited

U.S. PATENT DOCUMENTS

| | | | | |
|---|---|---|---|---|
| 2,012,765 A | | 8/1935 | Pierre | |
| 3,025,153 A | * | 3/1962 | Stanley | B22D 7/104 149/40 |
| 5,288,455 A | | 2/1994 | Siga et al. | |
| 5,505,682 A | | 4/1996 | Shimizu | |
| 2011/0174457 A1 | * | 7/2011 | Abraham | C21C 7/0075 164/4.1 |

FOREIGN PATENT DOCUMENTS

| | | | | | |
|---|---|---|---|---|---|
| CN | 101956145 A | | | 1/2011 | |
| CN | 102417965 A | | | 4/2012 | |
| CN | 102634738 A | | | 8/2012 | |
| CN | 103397267 A | | | 11/2013 | |
| CN | 103436802 A | | | 12/2013 | |
| CN | 104525889 A | | * | 4/2015 | |
| CN | 104593691 A | | * | 5/2015 | C22C 38/02 |
| CN | 106011665 A | | | 10/2016 | |
| CN | 108220775 A | | | 6/2018 | |
| CN | 108277443 A | | | 7/2018 | |
| JP | H04172113 A | | | 6/1992 | |
| JP | H08269626 A | | | 10/1996 | |

OTHER PUBLICATIONS

Abstract & computer-generated translation of CN 103436802 (A) (Applicants: Sinosteel Xingtai Machinery & Mill Roll Co Ltd; INVENTORS: Yang Yudong, Gao Xinsheng), originally published on Dec. 11, 2013. (Year: 2013).*

Zhao Xichun , Heat Treatment of Metals, Research on Cr5-Type Forged Steel for Backup Roll, Jun. 2003, pp. 26-28, vol. 28, Issue 6, China.

* cited by examiner

*Primary Examiner* — Vanessa T. Luk

(57) ABSTRACT

The present disclosure discloses a method for manufacturing an equal-hardness Cr5 back up roll. The method comprises the following steps: 1) preparing a steel raw material according to chemical components and weight percentage contents in a Cr5 back up roll material, and preparing a steel ingot according to a smelting procedure production process; 2) preparing a roller blank from the steel ingot according to a forging procedure production process; 3) performing thermal treatment on the roller blank; and 4) processing and detecting the roller blank to obtain an equal-hardness forged steel back up roll. The present disclosure solves problems that a hardness, an abrasion resistance, and a contact fatigue of a conventional forged steel back up roll are rapidly reduced in a middle and later use period, and prolongs a comprehensive use period and a service life of the back up roll.

8 Claims, No Drawings

METHOD FOR MANUFACTURING EQUAL-HARDNESS CR5 BACK UP ROLL

CROSS-REFERENCE TO RELATED APPLICATIONS

This application is a continuation of International Patent Application No. PCT/CN2021/090470 with a filing date of Apr. 28, 2021, designating the United States, now pending, and further claims priority to Chinese Patent Application No. 202011491042.1 with a filing date of Dec. 16, 2020. The content of the aforementioned applications, including any intervening amendments thereto, are incorporated herein by reference.

FIELD OF TECHNOLOGY

The present disclosure relates to the field of mechanical manufacturing, particularly to a method for manufacturing an equal-hardness Cr5 back up roll.

BACKGROUND

A modern rolling mill is developed towards high efficiency and high precision, so as to roll a product with a higher precision and a lower cost. A back up roll plays a supporting role to prevent a working roll from bending and deforming. Some back up rolls also play a role in transmitting a rolling force. Therefore, the back up roll is required to have high strength and toughness, and a working layer has a high abrasion resistance, a contact fatigue strength, and the like. Besides, a more advanced rolling technology requires a higher performance of the back up roll. The modern rolling mill almost totally uses the back up roll manufactured by a forged steel. A material is gradually upgraded from Cr2 and Cr3 to Cr5 to improve indexes such as an intensity and an abrasion resistance. However, performances of the existing forged steel back up roll are seriously reduced in a middle and later use period, which are mainly manifested as a rapidly reduced hardness, and an insufficient abrasion resistance and a contact fatigue. Fundamental reasons are that the material is insufficient in hardenability, a conventional flame differential temperature and a guarantee capability of a quenching process are insufficient, a structure of the working layer of the back up roll is uneven, or a pearlite structure with a low hardness appears in the working layer in the middle and later use period, such that the abrasion resistance is insufficient.

The hardenability and a hardness retention capability of the working layer are improved by increasing the content of alloy elements. However, since the forged steel back up roll of the modern rolling mill has a relatively large specification, the material is higher, segregation is more serious, uniformity and performances are more difficult to control, and processes such as smelting, forging, and thermal treatment are more difficult. Therefore, the main-stream material of the back up roll is still Cr5 at present. Under the background, various manufacturing plants are innovated through various process technical methods to improve the uniformity and the performances of a product.

SUMMARY

The present disclosure needs to solve a technical problem of providing a method for manufacturing an equal-hardness Cr5 back up roll, solves problems that a hardness, an abrasion resistance, and a contact fatigue of a conventional forged steel back up roll are rapidly reduced in a middle and later use period, and prolongs a comprehensive use period and a service life of the back up roll.

To solve the above-mentioned technical problems, the technical solution adopted by the present disclosure is: a method for manufacturing an equal-hardness Cr5 back up roll, comprising the following steps:

1) preparing steel raw materials according to chemical components in weight percentages for a Cr5 back up roll, and obtaining a steel ingot according to a smelting procedure production process;
2) preparing a roller blank from the steel ingot according to a forging procedure production process;
3) performing thermal treatment on the roller blank; and
4) processing and detecting the roller blank to obtain the equal-hardness Cr5 back up roll.

The technical solution of the present disclosure is further improved in: the chemical components in weight percentages for the Cr5 back up roll material are:

0.40%~0.70% of C, 0.20%~0.80% of Si, 0.20%~0.80% of Mn, 4.00%~5.00% of Cr, 0.20%~0.60% of Ni, 0.10%~0.80% of Mo, 0.10%~0.50% of V, P≤0.015%, S≤0.015%, and the balance Fe and an inevitable impurity.

The technical solution of the present disclosure is further improved in: the chemical components in weight percentages for the Cr5 back up roll material are: 0.55%~0.60% of C, 0.40%~0.45% of Si, 0.35%~0.38% of Mn, 4.50%~5.00% of Cr, 0.20%~0.60% of Ni, 0.60%~0.70% of Mo, 0.20%~0.30% of V, P≤0.015%, S≤0.010%, and the balance Fe and an inevitable impurity.

The technical solution of the present disclosure is further improved in: the smelting procedure for the steel ingot in step 1) comprises the following specific steps:

A. smelting the steel raw materials by using an electric arc furnace and refining ladle furnace, testing the chemical components and the weight percentages of molten steel in the refining ladle furnace, and performing degassing in vacuum after the molten steel is tested to be qualified; and
B. injecting molten iron into a steel ingot mold in a vacuum environment to form the steel ingot, wherein the steel ingot mold has a small height-diameter ratio and a large taper, a section is in a multi-edge design, and a high-efficiency exothermic compound is used in a riser.

The technical solution of the present disclosure is further improved in: in step 2), the steel ingot is heated and preserved for a period of time before forging, then transferred to an 80MN oil press for forging, and prepared into a forging blank through upsetting and drawing-out forging, wherein during the forging process, methods of high-temperature slow forging, medium-temperature fast forging, and low-temperature slow forging are used, and the forging blank is turned after being subjected to a post-forging thermal treatment to obtain a fine-grain roller blank.

The technical solution of the present disclosure is further improved in: the steel ingot is heated at a temperature in a range of 1,200~1,300° C. before the forging for 20~30 h; and during the forging process, the high-temperature slow forging is performed at a temperature in a range of 1,100~1,300° C.; the medium-temperature fast forging is performed at a temperature in a range of 900~1,100° C.; and the low-temperature slow forging is performed at a temperature in a range of 750~900° C.

The technical solution of the present disclosure is further improved in: the post-forging thermal treatment comprises the following specific processes: the forging blank is heated to 750~850° C., preserved for 10~20 h, then slowly cooled to 680~720° C., preserved for 30~40 h, and then annealed.

The technical solution of the present disclosure is further improved in: the thermal treatment of the roller blank in step 3) comprises the following specific steps:

(1) preheating: preheating the processed roller blank in a trolley furnace at a preheating temperature in a range of 400~500° C., and heat-preserving the roller blank for 10~20 h;

(2) transferring the preheated roller blank into an induction-type differential-temperature quenching device, wherein the induction-type differential-temperature quenching device has a surface temperature measurement precision of 0.1° C. and a surface temperature uniformity of ≤2° C., rapidly heating a steel blank to 950~1,050° C. in the induction-type differential-temperature quenching device at a speed of 15~20° C./min, and heat-preserving the steel blank for 100~150 min;

(3) transferring the heated roller blank into a quenching device with a continuously controllable cooling speed for quenching, opening a pipeline by adjusting an electromagnetic valve, simultaneously detecting a flow rate and a pressure of the pipeline according to a flowmeter and a pressure gauge respectively, wherein the roller blank is rapidly cooled within an initial 20~30 min, water cooling is used in the rapid cooling stage, the flow rate is controlled to be 300~600 cubic meters/hour, then the flow rate is reduced, and the flow rate is controlled to be 150~250 cubic meters/hour, such that a working layer is a fully quenched martensite structure; and (4) tempering the quenched roller blank at a tempering temperature in a range of 300~500° C.

The technical solution of the present disclosure is further improved in: in step 4), a surface hardness and a hardness drop of a roller body are detected by using a D-type mechanical Shore hardness tester, a hardness within 80 mm of a surface of the roller body is in range of 60~75 HS, a hardness uniformity is ≤2 HS, a working layer is detected according to a metallographic detection method, and a metallographic structure within 80 mm of the surface of the roller body is a quenched tempered martensite structure.

Since the technical solution is used, the present disclosure achieves the following technical progresses:

1. The present disclosure obtains an equal-hardness forged steel back up roll with a good hardness retentivity and structure uniformity by improving a material and a manufacturing method of a conventional Cr5 back up roll, improves an abrasion resistance, a contact fatigue performance, and a strength and toughness of a working layer, so as to improve a comprehensive use effect in a whole service period, improve a steel rolling production efficiency, and reduce consumption of the back up roll.

2. The present disclosure improves chemical components and weight percentage contents in the conventional Cr5 back up roll material. Compared with the traditional Cr5 back up roll material, the present disclosure optimizes the content of C, Ni, Mo, and V alloy elements in the roller material, improves the content of C, Ni, Mo, and V compared with the original Cr5 material. Since the content of Mo and V is improved, Mo and C form an M2C type carbide, V and C form an MC type carbide, the quantity of the M2C and MC carbides is increased. Since the M2C and MC carbides have a highest hardness and elastic modulus, hardenability of the material is obviously improved, the quantity of the alloy carbides is increased, and an abrasion resistance of the roller is improved. An M7C3 type carbide is mainly a Cr carbide, the Cr content in the traditional Cr5 back up roll material is 5.00%-5.50%, and the Cr content after the optimization of the present disclosure is 4.00%-5.00%. Compared with reduction of the traditional Cr5 back up roll material, the material is optimized, an "equal-hardness" effect is achieved, and the abrasion resistance and a contact fatigue strength are ensured at the same time by a heating technology and a cooling technology. The present disclosure ensures the M7C3 type carbide content with a best fracture toughness. In a use process, an abrasion mechanism of the roller comprises cutting, brittle fracture, and separation of the carbide and a matrix. The M7C3 has a better toughness, such that a phenomenon of carbide breaking and stripping is not obvious in the use process. In an abrasion process, the carbide may effectively protect the matrix, the matrix may relieve a higher internal stress born by a carbide region through a plastic deformation mode, has supporting and protecting effects on the carbide, and effectively prevents cracks from expanding, thereby improving the contact fatigue strength of the back up roll.

3. Aiming at serious component segregation and poor solidification quality existing in steel ingot smelting and casting, the present disclosure optimally designs a shape of a steel ingot mold, the used steel ingot mold has a small height-diameter ratio and a large taper, a section is in a multi-edge design, a heat-dissipation area is increased, a solidification speed is improved, a solidification segregation is reduced, at the same time, a high-efficiency exothermic compound is used in a riser, and solidification quality of the riser is improved.

4. The present disclosure obtains a fine-grain roller blank, improves strength and toughness of the roller blank, and at the same time avoids generation of forging cracks by studying stress, strain conditions, and internal microstructure changes of the steel ingot in the forging process under different anvil shapes and deformation modes and using high-temperature slow forging, medium-temperature fast forging, and low-temperature slow forging methods.

5. A roller blank thermal treatment in the present disclosure uses a process of preheating+induction-type differential-temperature heating+controllable cooling speed quenching, a heating speed is high, a surface temperature uniformity may be controlled within 2° C., a surface temperature measurement precision is 0.1° C., an austenitizing depth of a roller body is 100~120 mm, and an austenite grain is fine and uniform, and has a grain size about 10~11 grades. By adjusting a quenching medium and flow rate, a fully quenched martensite structure is obtained within 80 mm of a surface of the roller body, the hardness of the working layer is improved, a hardness range within 80 mm of the surface of the roller body is 60~75 HS, and a hardness uniformity is ≤2 HS.

6. An abrasion resistance of the Cr5 back up roll in the present disclosure is improved by 20% compared with the conventional Cr5 forged steel back up roll. The contact fatigue strength of the Cr5 back up roll is over 2 million of revolutions in a fatigue period under an experimental condition, and a comprehensive service period in a whole service period is improved by 20% compared with the conventional Cr5 forged steel back up roll.

DESCRIPTION OF THE EMBODIMENTS

The present disclosure is further described in detail below with reference to the following examples.

A method for manufacturing an equal-hardness Cr5 back up roll comprises the following steps:

1) Steel raw materials according to chemical components in weight percentages for a Cr5 back up roll is prepared, and a steel ingot is obtained according to a smelting procedure production process, wherein the chemical components and the weight percentage contents in the Cr5 back up roll material are: 0.40%~0.70% of C, 0.20%~0.80% of Si, 0.20%~0.80% of Mn, 4.00%~5.00% of Cr, 0.20%~0.60% of Ni, 0.10%~0.80% of Mo, 0.10%~0.50% of V, P≤0.015%, S≤0.015%, and the balance Fe and an inevitable impurity.

The chemical components and the weight percentage contents in the Cr5 back up roll material are preferably: 0.55%~0.60% of C, 0.40%~0.45% of Si, 0.35%~0.38% of Mn, 4.50%~5.00% of Cr, 0.20%~0.60% of Ni, 0.60%~0.70% of Mo, 0.20%~0.30% of V, P≤0.015%, S≤0.010%, and the balance Fe and an inevitable impurity.

The smelting procedure for the steel ingot comprises the following specific steps:

A. smelting the steel raw materials by using an electric arc furnace and refining ladle furnace, testing the chemical components and the weight percentages of molten steel in the refining ladle furnace, and performing degassing in vacuum after the molten steel is tested to be qualified; and B. injecting molten iron into a steel ingot mold in a vacuum environment to form the steel ingot, wherein since Cr, Mo and other alloy elements have a high content and the steel ingot has a large specification, a shape of a steel ingot mold is optimized for the material, the steel ingot mold has a small height-diameter ratio and a large taper, a section is in a multi-edge design, a heat-dissipation area is increased, a solidification speed is improved, a solidification segregation is reduced, at the same time, a high-efficiency exothermic compound is used in a riser, and solidification quality of the riser is improved.

2) A roller blank is prepared from the steel ingot according to a forging procedure production process; the forging procedure comprises the following specific processes: the steel ingot is heated to 1,200~1,300° C. in a trolley furnace before forging for 20~30 h, then transferred to an 80MN oil press for forging, and prepared into a forging blank through upsetting and drawing-out forging, wherein during the forging process, methods of high-temperature slow forging, medium-temperature fast forging, and low-temperature slow forging are used, the high-temperature slow forging is performed at a temperature in a range of 1,100~1,300° C., the medium-temperature fast forging is performed at a temperature in a range of 900~1,100° C., the low-temperature slow forging is performed at a temperature in a range of 750~900° C., the steel ingot is gently pressed in a high-temperature area, starts a large-pressure control until a middle-temperature section, actual operation time is based on a specific product design forging process, and the forging blank is turned after being subjected to a post-forging thermal treatment to obtain a fine-grain roller blank; and the post-forging thermal treatment comprises the following specific processes: the forging blank is heated to 750~850° C., preserved for 10~20 h, then slowly cooled to 680~720° C., preserved for 30~40 h, and then annealed.

3) The roller blank is thermally treated; and the thermal treatment comprises the following specific steps:

(1) preheating: preheating the processed roller blank in a trolley furnace at a preheating temperature in a range of 400~500° C., and heat-preserving the roller blank for 10~20 h;

(2) transferring the preheated roller blank into an induction-type differential-temperature quenching device, wherein the induction-type differential-temperature quenching device has a surface temperature measurement precision of 0.1° C. and a surface temperature uniformity of ≤2° C., rapidly heating a steel blank to 950~1,050° C. in the induction-type differential-temperature quenching device at a speed of 15~20° C./min, and heat-preserving the steel blank for 100~150 min;

(3) transferring the heated roller blank into a quenching device with a continuously controllable cooling speed for quenching, opening a pipeline by adjusting an electromagnetic valve, simultaneously detecting a flow rate and a pressure of the pipeline according to a flowmeter and a pressure gauge respectively, wherein the roller blank is rapidly cooled within an initial 20~30 min, water cooling is used in the rapid cooling stage, the flow rate is controlled to be 300~600 cubic meters/hour, then the flow rate is reduced, and the flow rate is controlled to be 150~250 cubic meters/hour, such that a working layer is a fully quenched martensite structure; and (4) tempering the quenched roller blank at a tempering temperature in a range of 300~500° C.

4) The roller blank is processed and detected to obtain an equal-hardness forged steel back up roll: a surface hardness and a hardness drop of a roller body are detected by using a D-type mechanical Shore hardness tester, a hardness within 80 mm of a surface of the roller body is in range of 60~75 HS, a hardness uniformity is ≤2 HS, a working layer is detected according to a metallographic detection method, and a metallographic structure within 80 mm of the surface of the roller body is a quenched tempered martensite structure.

The present disclosure is further described in detail below with reference to the following examples.

Example 1 to Example 4

TABLE 1

Comparisons of main chemical components and weight percentage contents of back up roll of examples 1-4

| Chemical component | Example 1 | Example 2 | Example 3 | Example 4 |
|---|---|---|---|---|
| C (%) | 0.55 | 0.59 | 0.58 | 0.60 |
| Si (%) | 0.45 | 0.42 | 0.40 | 0.42 |
| Mn (%) | 0.35 | 0.35 | 0.38 | 0.36 |
| Cr (%) | 4.00 | 4.50 | 5.00 | 4.75 |
| Ni (%) | 0.40 | 0.38 | 0.34 | 0.49 |

TABLE 1-continued

| Comparisons of main chemical components and weight percentage contents of back up roll of examples 1-4 | | | | |
|---|---|---|---|---|
| Chemical component | Example 1 | 2 | 3 | 4 |
| Mo (%) | 0.65 | 0.60 | 0.62 | 0.70 |
| V (%) | 0.20 | 0.21 | 0.25 | 0.30 |
| P (%) | 0.010 | 0.010 | 0.011 | 0.010 |
| S (%) | 0.004 | 0.005 | 0.005 | 0.007 |

TABLE 2

| Comparisons of process parameters of examples 1-4 | | | | | |
|---|---|---|---|---|---|
| | Process parameter | Example 1 | 2 | 3 | 4 |
| Forging procedure | Heating temperature of steel ingot (° C.) | 1300 | 1250 | 1200 | 1280 |
| | Heat-preserving time (h) | 20 | 25 | 30 | 25 |
| | Post-forging heating temperature (° C.) | 830 | 800 | 750 | 850 |
| | Heat-preserving time (h) | 15 | 10 | 20 | 16 |
| | Post-slow cooling temperature (° C.) | 680 | 720 | 680 | 700 |
| | Heat-preserving time (h) | 40 | 40 | 40 | 30 |
| Thermal treatment | Preheating temperature (° C.) | 450 | 400 | 500 | 400 |
| | Heat-preserving time (h) | 20 | 15 | 20 | 10 |
| | Differential-temperature heating speed (° C./min) | 20 | 15 | 18 | 15 |

TABLE 2-continued

| Comparisons of process parameters of examples 1-4 | | | | |
|---|---|---|---|---|
| Process parameter | Example 1 | 2 | 3 | 4 |
| Differential-temperature heating temperature (° C.) | 980 | 950 | 1050 | 980 |
| Differential-temperature heating preserving time (min) | 100 | 150 | 150 | 125 |
| Rapid cooling time (min) | 30 | 30 | 20 | 25 |

TABLE 3

| Comparisons of hardness detection results of examples 1-4 | | | | |
|---|---|---|---|---|
| Depth from surface (mm) | Example 1 | 2 | 3 | 4 |
| 0 | 65 | 75 | 70 | 69 |
| 20 | 65 | 75 | 71 | 70 |
| 40 | 66 | 75 | 71 | 70 |
| 50 | 66 | 75 | 70 | 70 |
| 60 | 65 | 74 | 70 | 70 |
| 70 | 64 | 74 | 69 | 69 |
| 80 | 64 | 74 | 69 | 68 |
| 90 | 61 | 73 | 67 | 66 |
| 100 | 60 | 71 | 65 | 65 |
| 110 | 56 | 69 | 63 | 62 |
| 120 | 47 | 64 | 60 | 60 |

TABLE 4

| Comparisons of metallographic structure detection results of examples 1-4 | | | | |
|---|---|---|---|---|
| Depth from surface (mm) | Example 1 | 2 | 3 | 4 |
| 0 | Tempered sorbite + carbide | Tempered sorbite + carbide | Tempered sorbite + carbide | Tempered sorbite + carbide |
| 20 | Tempered sorbite + carbide | Tempered sorbite + carbide | Tempered sorbite + carbide | Tempered sorbite + carbide |
| 40 | Tempered sorbite + carbide | Tempered sorbite + carbide | Tempered sorbite + carbide | Tempered sorbite + carbide |
| 50 | Tempered sorbite + carbide | Tempered sorbite + carbide | Tempered sorbite + carbide | Tempered sorbite + carbide |
| 60 | Tempered sorbite + carbide | Tempered sorbite + carbide | Tempered sorbite + carbide | Tempered sorbite + carbide |
| 70 | Tempered sorbite + carbide | Tempered sorbite + carbide | Tempered sorbite + carbide | Tempered sorbite + carbide |
| 80 | Tempered sorbite + carbide | Tempered sorbite + carbide | Tempered sorbite + carbide | Tempered sorbite + carbide |
| 90 | Tempered sorbite + a small amount of pearlite + carbide | Tempered sorbite + carbide | Tempered sorbite + carbide | Tempered sorbite + carbide |
| 100 | Tempered sorbite + pearlite + carbide | Tempered sorbite + carbide | Tempered sorbite + a small amount of pearlite + carbide | Tempered sorbite + a small amount of pearlite + carbide |
| 110 | Tempered sorbite + pearlite + carbide | Tempered sorbite + a small amount of pearlite + carbide | Tempered sorbite + pearlite + carbide | Tempered sorbite + pearlite + carbide |
| 120 | Tempered sorbite + pearlite + carbide | Tempered sorbite + pearlite + carbide | Tempered sorbite + pearlite + carbide | Tempered sorbite + pearlite + carbide |

Comparative Examples 5-8

Compared with example 1, comparative example 5 had the following distinguishing technical characteristic: a heating mode of flame differential temperature was used in the thermal treatment process.

Compared with example 2, comparative example 6 had the following distinguishing technical characteristic: a conventional water cooling process was used for cooling in the thermal treatment process.

Compared with example 3, comparative example 7 had the following distinguishing technical characteristic: relatively short rapid cooling time of 15 min was used in the thermal treatment process.

Compared with example 4, comparative example 8 had the following distinguishing technical characteristic: differential-temperature heating preserving time of 160 min was used in the thermal treatment process.

TABLE 5

Process parameters of thermal treatment of examples 5-8

| | Process parameter | Example 5 | 6 | 7 | 8 |
|---|---|---|---|---|---|
| Thermal treatment | Preheating temperature (° C.) | 450 | 400 | 500 | 400 |
| | Heat-preserving time (h) | 20 | 15 | 20 | 10 |
| | Differential-temperature heating speed (° C./min) | 20 | 15 | 18 | 15 |
| | Differential-temperature heating temperature (° C.) | 980 | 950 | 1050 | 980 |
| | Differential-temperature heating preserving time (min) | 100 | 150 | 150 | 160 |
| | Rapid cooling time (min) | 30 | 30 | 15 | 25 |

TABLE 6

Comparisons of hardness detection results of comparative examples 5-8

| Depth from surface (mm) | Example 5 | 6 | 7 | 8 |
|---|---|---|---|---|
| 0 | 65 | 73 | 70 | 69 |
| 20 | 65 | 72 | 71 | 70 |
| 40 | 64 | 68 | 69 | 67 |
| 50 | 63 | 67 | 65 | 63 |
| 60 | 60 | 59 | 60 | 60 |
| 70 | 58 | 55 | 57 | 56 |
| 80 | 53 | 52 | 52 | 50 |
| 90 | 48 | 50 | 44 | 45 |
| 100 | 38 | 48 | 38 | 40 |
| 110 | 42 | 48 | 37 | 37 |
| 120 | 43 | 44 | 40 | 36 |

TABLE 7

Comparisons of metallographic structure detection results of comparative examples 5-8

| Depth from surface (mm) | Example 5 | 6 | 7 | 8 |
|---|---|---|---|---|
| 0 | Tempered sorbite + carbide | Tempered sorbite + carbide | Tempered sorbite + carbide | Tempered sorbite + carbide |
| 20 | Tempered sorbite + carbide | Tempered sorbite + carbide | Tempered sorbite + carbide | Tempered sorbite + carbide |
| 40 | Tempered sorbite + carbide | Tempered sorbite + carbide | Tempered sorbite + carbide | Tempered sorbite + carbide |
| 50 | Tempered sorbite + carbide | Tempered sorbite + carbide | Tempered sorbite + carbide | Tempered sorbite + carbide |
| 60 | Tempered sorbite + a small amount of pearlite + carbide | Tempered sorbite + a small amount of pearlite + carbide | Tempered sorbite + a small amount of pearlite + carbide | Tempered sorbite + a small amount of pearlite + carbide |
| 70 | Tempered sorbite + pearlite + carbide | Tempered sorbite + pearlite + carbide | Tempered sorbite + a small amount of pearlite + carbide | Tempered sorbite + a small amount of pearlite + carbide |
| 80 | Tempered sorbite + pearlite + carbide | Tempered sorbite + pearlite + carbide | Tempered sorbite + a small amount of pearlite + carbide | Tempered sorbite + a small amount of pearlite + carbide |
| 90 | Tempered sorbite + pearlite + carbide | Tempered sorbite + pearlite + carbide | Pearlite + carbide | Pearlite + carbide |
| 100 | Pearlite + carbide | Pearlite + carbide | Pearlite + carbide | Pearlite + carbide |
| 110 | Pearlite + | Pearlite + | Pearlite + | Pearlite + |

TABLE 7-continued

| Comparisons of metallographic structure detection results of comparative examples 5-8 | | | | |
|---|---|---|---|---|
| Depth from surface | Example | | | |
| (mm) | 5 | 6 | 7 | 8 |
| 120 | carbide Pearlite + carbide | carbide Pearlite + carbide | carbide Pearlite + carbide | carbide Pearlite + carbide |

In conclusion: aiming at serious component segregation and poor solidification quality existing in steel ingot smelting and casting, the present disclosure optimally designs a shape of a steel ingot mold, the used steel ingot mold has a small height-diameter ratio and a large taper, a section is in a multi-edge design, a heat-dissipation area is increased, a solidification speed is improved, a solidification segregation is reduced, at the same time, a high-efficiency exothermic compound is used in a riser, and solidification quality of the riser is improved. The present disclosure obtains a fine-grain roller blank, improves strength and toughness of the roller blank, and at the same time avoids generation of forging cracks by studying stress, strain conditions, and internal microstructure changes of the steel ingot in the forging process under different anvil shapes and deformation modes, and using high-temperature slow forging, medium-temperature fast forging, and low-temperature slow forging methods. A roller blank thermal treatment uses a process of preheating+induction-type differential-temperature heating+controllable cooling speed quenching, a heating speed is high, a surface temperature uniformity may be controlled within 2° C., a surface temperature measurement precision is 0.1° C., an austenitizing depth of a roller body is 100~120 mm, and an austenite grain is fine and uniform, and has a grain size about 10~11 grades. A pipeline is opened by adjusting an electromagnetic valve, a flow rate and a pressure of the pipeline are simultaneously detected according to a flowmeter and a pressure gauge respectively, the roller blank is rapidly cooled within an initial 20~30 min, water cooling is used in the rapid cooling stage, the flow rate is controlled to be 300~600 cubic meters/hour, then the flow rate is reduced, and the flow rate is controlled to be 150~250 cubic meters/hour, such that a fully quenched martensite structure is obtained within 80 mm of a surface of the roller body, a hardness of a working layer is improved, a hardness range within 80 mm of the surface of the roller body is 60~75 HS, and a hardness uniformity is ≤2 HS. An abrasion resistance of the Cr5 back up roll in the present disclosure is improved by 20% compared with the conventional Cr5 forged steel back up roll. The contact fatigue strength of the Cr5 back up roll is over 2 million of revolutions in a fatigue period under an experimental condition, and a comprehensive service period in a whole service period is improved by 20% compared with the conventional Cr5 forged steel back up roll.

What is claimed is:

1. A method for manufacturing an equal-hardness Cr5 back up roll, comprising the following steps:

1) Preparing steel raw materials according to chemical components in weight percentages for a Cr5 back up roll, and obtaining a steel ingot according to a smelting procedure production process;

2) Preparing a roller blank from the steel ingot according to a forging procedure production process;

3) Performing thermal treatment on the roller blank; and

4) Processing and detecting the roller blank to obtain the equal-hardness Cr5 back up roll;

wherein the thermal treatment of the roller blank in step 3) comprises the following specific steps:

(1) preheating: preheating the processed roller blank in a trolley furnace at a preheating temperature in a range of 400~500° C., and heat-preserving the roller blank for 10~20 h;

(2) transferring the preheated roller blank into an induction-type differential-temperature quenching device, wherein the induction-type differential-temperature quenching device has a surface temperature measurement precision of 0.1° C. and a surface temperature uniformity of ≤2° C., rapidly heating a steel blank to 950~1,050° C. in the induction-type differential-temperature quenching device at a speed of 15~20° C./min, and heat-preserving the steel blank for 100~150 min;

(3) transferring the heated roller blank into a quenching device with a continuously controllable cooling speed for quenching, opening a pipeline by adjusting an electromagnetic valve, simultaneously detecting a flow rate and a pressure of the pipeline according to a flowmeter and a pressure gauge respectively, wherein the roller blank is rapidly cooled within an initial 20~30 min, water cooling is used in the rapid cooling stage, the flow rate is controlled to be 300~600 cubic meters/hour, then the flow rate is reduced, and the flow rate is controlled to be 150~250 cubic meters/hour, such that a working layer is a fully quenched martensite structure; and (4) tempering the quenched roller blank at a tempering temperature in a range of 300~500° C.

2. The method according to claim 1, wherein the chemical components in weight percentages for the Cr5 back up roll are:

0.40%~0.70% of C, 0.20%~0.80% of Si, 0.20%~0.80% of Mn, 4.00%~5.00% of Cr, 0.20%~0.60% of Ni, 0.10%~0.80% of Mo, 0.10%~0.50% of V, P≤0.015%, S≤0.015%, and the balance Fe and an inevitable impurity.

3. The method according to claim 1, wherein the chemical components in weight percentages for the Cr5 back up roll material are:

0.55%~0.60% of C, 0.40%~0.45% of Si, 0.35%~0.38% of Mn, 4.50%~5.00% of Cr, 0.20%~0.60% of Ni, 0.60%~0.70% of Mo, 0.20%~0.30% of V, P≤0.015%, S≤0.010%, and the balance Fe and an inevitable impurity.

4. The method according to claim 1, wherein the smelting procedure for the steel ingot in step 1) comprises the following specific steps:

A. smelting the steel raw materials by using an electric arc furnace and a ladle furnace, testing chemical components and weight percentages of molten steel in the ladle furnace, and performing degassing in vacuum after the molten steel is tested to be qualified; and B. injecting molten iron into a steel ingot mold in a vacuum environment to form the steel ingot.

5. The method according to claim 1, wherein the steel ingot is heated and preserved for a period of time before the forging procedure in step 2), then transferred to an 80MN oil press for forging, and prepared into a forging blank through upsetting and drawing-out forging; during the forging process, methods of high-temperature forging, medium-temperature forging, and low-temperature forging are used; and the forging blank is turned after being subjected to a post-forging thermal treatment to obtain a fine-grain roller blank.

6. The method according to claim 5, wherein the steel ingot is heated at a temperature in a range of 1,200~1,300° C. before the forging for 20~30 h; and during the forging process, the high-temperature forging is performed at a temperature in a range of 1,100~1,300° C.; the medium-temperature forging is performed at a temperature in a range of 900~1,100° C.; and the low-temperature forging is performed at a temperature in range of 750~900° C.

7. The method according to claim 5, wherein the post-forging thermal treatment comprises the following specific processes: the forging blank is heated to 750~850° C., preserved for 10~20 h, then cooled to 680~720° C., preserved for 30~40 h, and then annealed.

8. The method according to claim 1, wherein a surface hardness and a hardness drop of a roller body are detected by using a D-type mechanical Shore hardness tester in step 4), a hardness within 80 mm of a surface of the roller body is in a range of 60~75 HS, a hardness uniformity is ≤2 HS, a working layer is detected according to a metallographic detection method, and a metallographic structure within 80 mm of the surface of the roller body is a quenched tempered martensite structure.

* * * * *